US010234178B2

(12) United States Patent
Schutte

(10) Patent No.: US 10,234,178 B2
(45) Date of Patent: Mar. 19, 2019

(54) FIN AND TUBE-EVAPORATOR WITH MINI-SLAB CIRCUIT EXTENDERS

(71) Applicant: Liebert Corporation, Columbus, OH (US)

(72) Inventor: Daniel J. Schutte, Lewis Center, OH (US)

(73) Assignee: Vertiv Corporation, Columbus, OH (US)

( * ) Notice: Subject to any disclaimer, the term of this patent is extended or adjusted under 35 U.S.C. 154(b) by 0 days.

(21) Appl. No.: 15/439,051

(22) Filed: Feb. 22, 2017

(65) Prior Publication Data

US 2017/0261244 A1 Sep. 14, 2017

Related U.S. Application Data

(60) Provisional application No. 62/307,653, filed on Mar. 14, 2016.

(51) Int. Cl.

| | |
|---|---|
| ***F28D 1/04*** | (2006.01) |
| ***F28F 1/32*** | (2006.01) |
| ***F25B 39/00*** | (2006.01) |
| ***F25B 39/02*** | (2006.01) |
| ***F28D 1/047*** | (2006.01) |
| ***F28D 21/00*** | (2006.01) |

(52) U.S. Cl.

CPC ..... *F25B 39/00* (2013.01); *F25B 39/02* (2013.01); *F28D 1/0477* (2013.01); *F28F 1/325* (2013.01); *F25B 39/028* (2013.01); *F25B 2500/09* (2013.01); *F28D 1/0426* (2013.01); *F28D 2021/0071* (2013.01); *F28F 1/32* (2013.01); *F28F 2210/10* (2013.01)

(58) Field of Classification Search

CPC ..... F28F 1/325; F28F 2210/10; F28F 1/32; F25B 39/02; F25B 2500/09; F25B 39/00; F25B 39/028; F28D 1/0477; F28D 2021/0071

USPC ..... 62/77

See application file for complete search history.

(56) References Cited

U.S. PATENT DOCUMENTS

| | | | | |
|---|---|---|---|---|
| 2,561,305 | A | 7/1951 | Limpert et al. | |
| 8,176,750 | B2 | 5/2012 | Higashiyama | |
| 8,561,427 | B2 | 10/2013 | Knight et al. | |
| 2010/0012307 | A1 | 1/2010 | Taras et al. | |
| 2013/0098088 | A1 * | 4/2013 | Lin | F25B 49/02 62/228.1 |
| 2015/0027677 | A1 | 1/2015 | Taras et al. | |

FOREIGN PATENT DOCUMENTS

WO WO-2015142615 A1 9/2015

* cited by examiner

*Primary Examiner* — Ana M Vazquez

(74) *Attorney, Agent, or Firm* — Harness, Dickey & Pierce, P.L.C.

(57) ABSTRACT

An evaporator for a cooling system has a slab coil having a plurality of refrigerant circuits with each refrigerant circuit being a fin-and-tube assembly that extends across the slab coil. At least one of the refrigerant circuits has a mini-slab circuit extender that has a fin-and-tube assembly that extends across only a portion of the fin-and-tube assembly of that refrigerant circuit and is disposed in front of that portion of the fin-and-tube assembly of that refrigerant circuit.

4 Claims, 3 Drawing Sheets

FIN AND TUBE-EVAPORATOR WITH MINI-SLAB CIRCUIT EXTENDERS

CROSS-REFERENCE TO RELATED APPLICATIONS

This application claims the benefit of U.S. Provisional Application No. 62/307,653 filed Mar. 14, 2016. The entire disclosure of the above application is incorporated herein by reference.

FIELD

The present disclosure relates to evaporators for cooling systems having a fin-and-tube coil.

BACKGROUND

This section provides background information related to the present disclosure which is not necessarily prior art.

One common type of evaporator for cooling systems is a fin-and-tube evaporator having one or more refrigerant circuits that are fin-and-tube cooling coils. Each refrigerant circuit has tubes that extend back and forth between opposed sides of the evaporator with fins affixed to the outside of the tubes. The tubes are fluidly coupled together, end to end. Refrigerant flows through the tubes and air to be cooled flows across the fins and outside of the tubes.

These evaporator coils can have various configurations, such as an A coil, V coil and slab coil. A slab coil configuration as the name implies has the configuration of a slab with the tube (or tubes) running back and forth across the slab with fins affixed to the outside of the tubes. A coil and V coil configurations typically have two slab coils arranged in an A or V configuration.

In a slab coil having a tall, relatively narrow configuration, air flow distribution across the slab coil as air to be cooled flows across it is less than optimum. The airflow face velocity of the air contacting the slab coil farthest from the air moving unit (such as a blower) used to blow the air across the slab coil is considerably reduced compared to the airflow face velocity of the air contacting the slab coil closest to the air moving unit which causes a wide variation in coil circuit temperatures. This results in lower coil capacity and lower efficiency of the system. One way of mitigating this effect is by the addition of more refrigerant tubes to the refrigerant circuits that are in the area of the lower airflow. A refrigerant circuit in this context is a plurality of tubes extending across the slab that are fluidly coupled together end to end to provide a continuous, serial refrigerant flow path through the tubes. A refrigerant circuit may for example have twelve such tubes with an inlet end of a first tube in the refrigerant circuit coupled to a refrigerant distributor and an outlet end of a last tube in refrigerant circuit fluidly coupled to a suction line. The coupled together tubes thus extend in a serpentine path back and forth across the coil slab. When the evaporator has a fin-and-tube evaporator coil configuration, each refrigerant circuit is a fin-and-tube coil with the tubes of the refrigerant circuit extending through fins that surround and contact the outer sides of the tubes. However, it is difficult to achieve good coil circuit distribution even by adding more refrigerant tubes in the area of lower airflow. The difficulty is that to add tubes to cold refrigerant circuits, tubes need to be removed from warmer refrigerant circuits since the height of the coil slab is limited. This can become an iterative process with less than desired results since multiple circuits are affected when adding/removing tubes from each. When there is a variation in coldest to warmest refrigerant circuit temperatures of more than 10° F., performance and system efficiency are less than optimal.

SUMMARY

This section provides a general summary of the disclosure, and is not a comprehensive disclosure of its full scope or all of its features.

In accordance with an aspect of the present disclosure, an evaporator for a cooling system has a slab coil having a plurality of refrigerant circuits with each refrigerant circuit being a fin-and-tube assembly that extends across the slab coil. At least one of the refrigerant circuits has a mini-slab circuit extender that has a fin-and-tube assembly that extends across only a portion of the fin-and-tube assembly of that refrigerant circuit. In an aspect, the mini-slab circuit extender is disposed with respect to the fin-and-tube assembly of the refrigerant circuit having that mini-slab circuit extender so a portion of air being cooled first flows across the fin-and-tube assembly of the mini-slab circuit extender and then across the portion of the fin-and-tube assembly of the refrigerant circuit having the mini-slab circuit extender.

In an aspect, the at least one refrigerant circuit that includes the mini-slab circuit extender is located at a low air flow area of the slab coil. In an aspect, each refrigerant circuit refrigerant circuit located at any low air flow area of the slab coil has its own mini-slab circuit extender.

In an aspect, the at least one refrigerant circuit that includes the mini-slab circuit extender is a cold refrigerant circuit. In an aspect, each refrigerant circuit that is a cold refrigerant circuit has its own mini-slab circuit extender. In an aspect, a cold refrigerant circuit is a refrigerant circuit that has a refrigerant circuit temperature that is at least 15° F. less than a refrigerant circuit temperature of a refrigerant circuit that has a highest refrigerant circuit temperature.

In an aspect, a method of making an evaporator for a cooling system includes assembling a plurality of refrigerant circuits in a slab coil with each refrigerant circuit being a fin-and-tube assembly that extends across the slab coil. The method further includes identifying any of the refrigerant circuits that are cold refrigerant circuits and assembling a mini-slab circuit extender to at least one of the cold refrigerant circuits so that the mini-slab circuit extender is disposed in front of or behind only a portion of the fin-and-tube assembly of that refrigerant circuit. In an aspect, assembling the mini-slab circuit extender to the at least one of the cold refrigerant circuits includes assembling a mini-slab circuit extender to each cold refrigerant circuit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
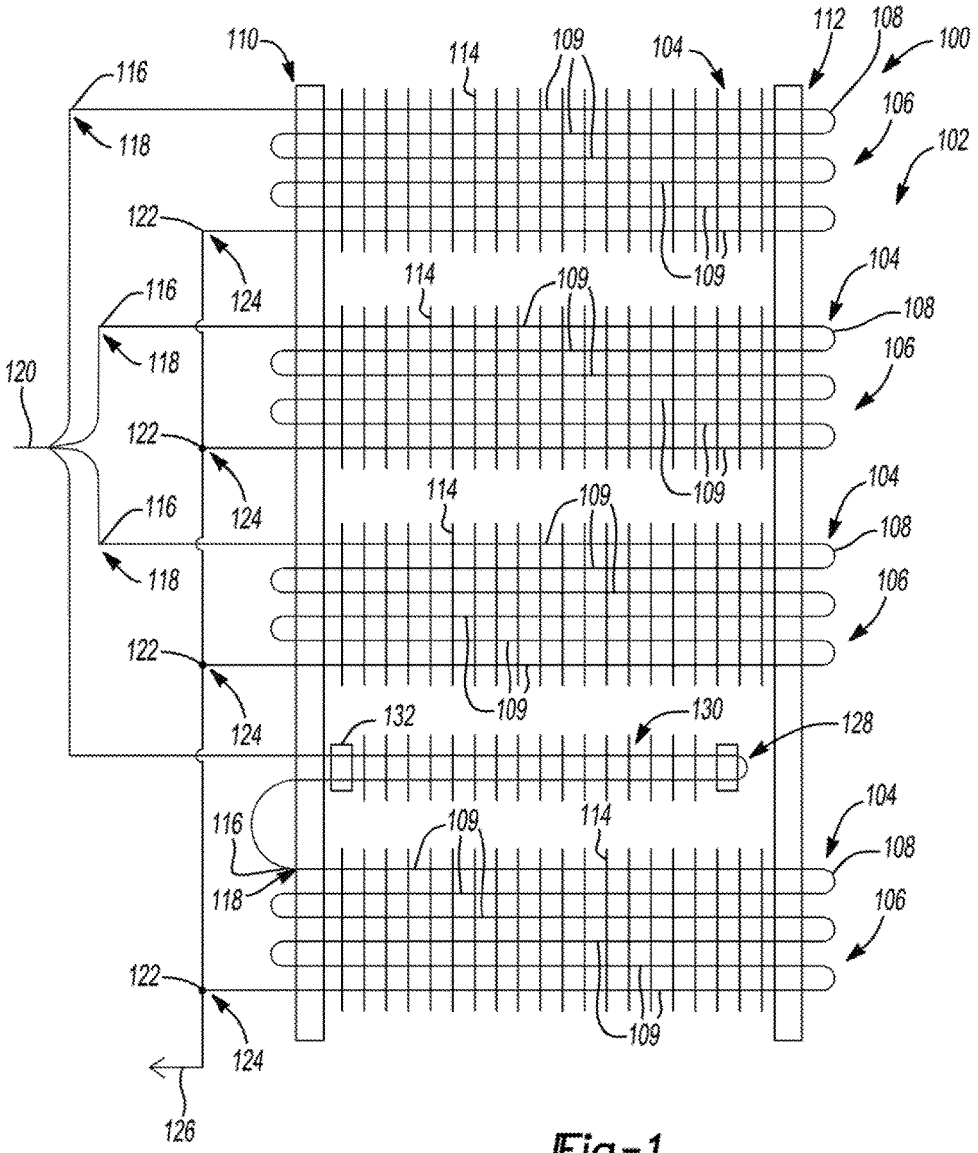
FIG. 1 is a simplified schematic of a piping topology of an evaporator in accordance with an aspect of the present disclosure having a plurality of refrigerant circuits with at least one refrigerant circuit having a mini-slab circuit extender.

FIG. 1 is a simplified piping schematic of a fin-and-tube evaporator 100 in accordance with an aspect of the present disclosure having a slab coil 102. Evaporator 100 has a plurality of refrigerant circuits 104. Each refrigerant circuit 104 is a fin-and-tube assembly 106 that has serpentine tube 108 that extends back and forth across the slab coil 102 between opposed sides 110, 112 of slab coil 102 in a serpentine path. The tube 108 extends through fins 114 that surround and contact an outer surface of the tube 108. Serpentine tube 108 for example includes a plurality of tube sections 109 that extend across the slab coil 102 and that are fluidly coupled together, end to end, and provide a continuous, serial, serpentine refrigerant flow path through tubes 109. An inlet end 116 of a first tube 108 in each refrigerant circuit 104 provides an inlet 118 of the refrigerant circuit and is fluidly coupled to a refrigerant distributor 120 and an outlet end 122 of a last tube 108 of each refrigerant circuit provides an outlet 124 of the refrigerant circuit 104 and is fluidly coupled to a suction line 126.

One or more of the refrigerant circuits 104 has a mini-slab circuit extender 128. In the illustrative example shown in FIG. 1, the lowermost refrigerant circuit 104 is shown as having mini-slab circuit extender 128, but it should be understood that more than one of the refrigerant circuits 104 can each have a mini-slab circuit extender 128 as discussed in more detail below. Mini-slab circuit extender 128 includes a fin-and-tube assembly 130 that extends across a portion, as described in more detail below, of the fin-and-tube assembly 106 of that refrigerant circuit 104 between opposed sides 132, 134 of mini-slab circuit extender 128. In an aspect, mini-slab circuit extender 128 is disposed with respect to fin-and-tube assembly 106 of the refrigerant circuit 104 having that mini-slab circuit extender 128 so a portion of air being cooled first flows across the fin-and-tube assembly 130 of the mini-slab circuit extender and then across the portion of the fin-and-tube assembly 106 of the refrigerant circuit 104 having the mini-slab circuit extender 128.

In the example of FIG. 1, the fin-and-tube assembly 130 of mini-slab circuit extender 128 is fluidly coupled in series with the fin-and-tube assembly 106 of the refrigerant circuit 104 having the mini-slab circuit extender 128, illustratively between the inlet 118 of that refrigerant circuit 104 and refrigerant distributor 120. In this example it should be understood that inlet 118 of refrigerant circuit 104 is fluidly coupled to refrigerant distributor 120 by the fin-and-tube assembly 130 of the mini-slab circuit extender 128 instead of directly to refrigerant distributor 120.

Figure 2:
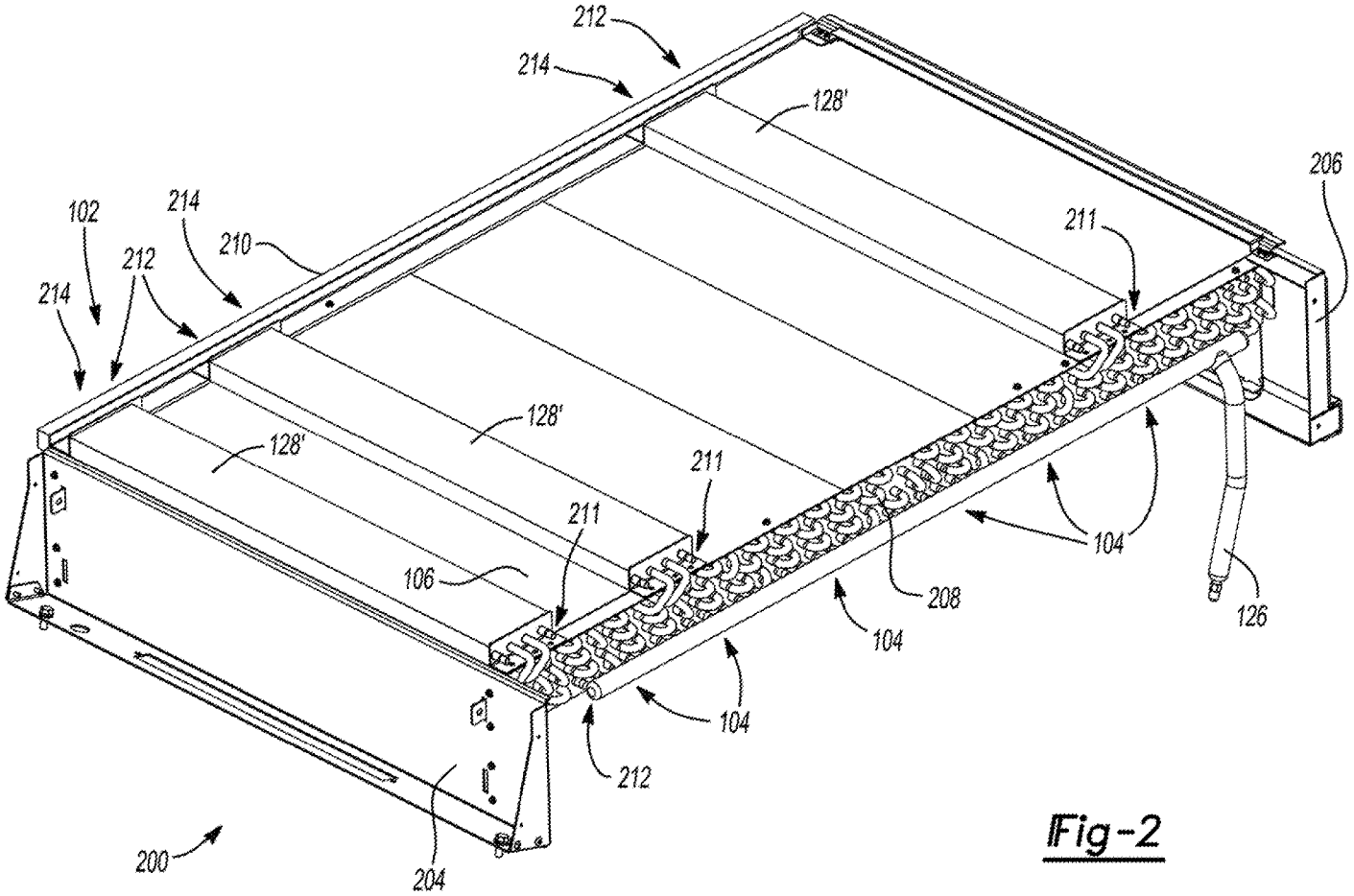
FIG. 2 is a perspective view of example of the evaporator of FIG. 1 having mini-slab circuit extender assemblies with each mini-slab circuit extender assembly having a plurality of mini-slab circuit extenders.

FIG. 2 shows evaporator 200 having slab coil configuration 102 that is an example implementation of a fin-and-tube evaporator, such as the evaporator 100 described above, having a plurality of refrigerant circuits 104 with a plurality of the refrigerant circuits 104 having the mini-slab circuit extenders 128. In the example of FIG. 2, more than one but less than all the refrigerant circuits 104 have the mini-slab circuit extenders 128. In the example of FIG. 2, evaporator 200 has a plurality of mini-slab circuit extenders assemblies 128' with each mini-slab circuit extenders assembly 128' having two mini-slab circuit extenders 128 that provide mini-slab circuit extenders 128 for two of refrigerant circuits 104. In the example of FIG. 2 and with reference to FIG. 3, the mini-slab circuit extenders 128 of the mini-slab circuit extenders assemblies 128' are each a fin-and-tube coil having two tubes.

It should be understood that in the example of FIG. 2, the fins of the fin-and-tube assemblies 106 of refrigerant circuit and the fins of the fin-and-tube assemblies 130 of mini-slab circuit extenders 128 are shown as solid blocks.

As oriented in FIG. 2, evaporator 200 has top and bottom walls 204, 206 and opposed sidewalls 208, 210. The fin-and-tube assemblies 106 (only one of which is identified by reference number 106 in FIG. 2) of refrigerant circuits 104 extend across slab coil 102 between sidewalls 208. Mini-slab circuit extender assemblies 128' also extend across slab coil 102 between sidewalls 208, 210.

In the example of FIG. 2, each mini-slab circuit extender 128 extends across a horizontal width of the refrigerant circuit 104 having that mini-slab circuit extender 128 and across a partial longitudinal length of that refrigerant circuit 104 so that the mini-slab circuit extender 128 extending across a portion 216 of the fin-and-tube assembly 106 of that refrigerant circuit 104 but not across a remaining portion 218 of that fin-and-tube assembly 106. More specifically, the fin-and-tube assembly 130 (FIG. 3) of the mini-slab circuit extender assembly 128' extends across a full horizontal width of the fin-and-tube assembly 106 of that refrigerant circuit 104 and across a partial longitudinal length of that fin-and-tube assembly 106. With respect to the foregoing, "horizontal" is a direction across slab 202 from sidewall 208 to sidewall 210 and "longitudinal" is a direction along slab 202 from top wall 204 to bottom wall 206.

In the example shown in FIG. 2, the mini-slab circuit extender assembly 128' of each refrigerant circuit 104 is disposed with respect to fin-and-tube assembly 106 of that refrigerant circuit 104 so that a portion of air being cooled first flows across the fin-and-tube assembly 130 of the mini-slab circuit extender 128 and then across the portion 216 of the fin-and-tube assembly 106 of the refrigerant circuit 104 having the mini-slab circuit extender 128. It should be understood that another portion of air being cooled also flows in parallel across the remaining portion 218 of each such fin-and-tube assembly 106.

Figure 3:
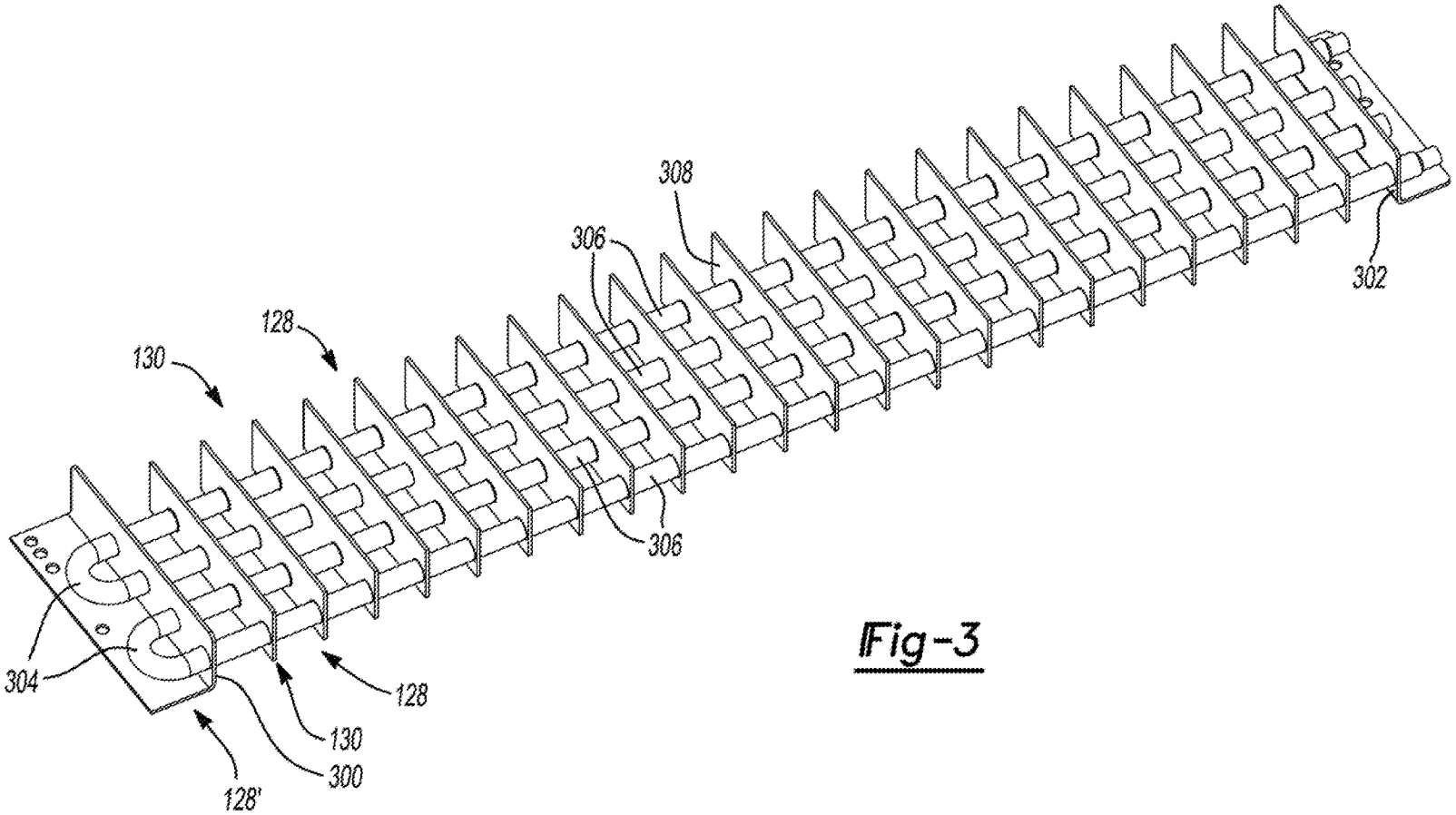
FIG. 3 is a perspective view of one of the mini-slab circuit extender assemblies of FIG. 2.

FIG. 3 shows an example of mini-slab circuit extender assembly 128' in more detail. Mini-slab circuit extender assembly 128' includes opposed flanged sidewalls 300, 302 and two fin-and-tube assemblies 130 each having a serpentine tube 304 having two tube sections 306, joined end to end, extending between opposed flanged sidewalls 300, 302 and through fins 308. Each fin-and-tube assembly 130 provides a mini-slab circuit extender 128 for one of refrigerant circuits 104.

The mini-slab circuit extenders 128 are added to those of refrigerant circuits 104 that are cold refrigerant circuits. A cold refrigerant circuit as used herein is a refrigerant circuit that has a refrigerant circuit temperature that is at least 15° F. less than a refrigerant circuit temperature of the refrigerant circuit that has a highest refrigerant circuit temperature. As used herein, refrigerant circuit temperature means the temperature of the refrigerant as it exits the refrigerant circuit.

As discussed above, there are areas of the evaporator that have lower air flow compared to other areas of the evaporator. The cold refrigerant circuits are in areas of the evaporator that have low air flow compared to other areas of the evaporator. In the example of FIG. 2, areas 212 are low air flow areas of the evaporator that have low air flow and refrigerant circuits 104 at these areas are cold refrigerant circuits 214 to which mini-slab circuit extenders 128 have been added. That is, less of the air being cooled flows across these low flow areas 212 of low air flow than other areas of the evaporator. As used herein, a low air flow areas of an evaporator, such as evaporator 200, means that the volume of flow of air (such as in cubic feet per minute) across the low flow area of the evaporator is at least 20% less than the volume of flow of air across an areas of the evaporator having a highest rate of air flow across it.

In accordance with an aspect of the present disclosure, a method of making an evaporator for a cooling system such as evaporator 200 includes assembling a plurality of refrigerant circuits in a slab coil configuration with each refrigerant circuit being a fin-and-tube coil that extends across the slab coil. Any cold refrigerant circuits are identified. A mini-slab circuit extender is assembled to at least one of the cold refrigerant circuits so that the mini-slab circuit extender is disposed in front of only a portion of the fin-and-tube coil of that cold refrigerant circuit. In an aspect, a mini-slab circuit extender is assembled to each cold refrigerant circuit and each cold refrigerant circuit thus has its own mini-slab circuit extender.

It should be understood that the foregoing can also be utilized for evaporators having configurations such as A-Coil and V-Coil configurations for example by arranging two slab coils 102 in an A or V configuration.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An evaporator for a cooling system, comprising:

a slab coil the slab coil having a plurality of refrigerant circuits with each refrigerant circuit being a fin-and-tube assembly that extends across the slab coil;

at least one of the refrigerant circuits having a mini-slab circuit extender that has a fin-and-tube assembly that is disposed across only a portion of the fin-and-tube assembly of that refrigerant circuit; and the at least one refrigerant circuit that has the mini-slab circuit extender is a cold refrigerant circuit that has a refrigerant circuit temperature that is at least 15° F. less than a refrigerant circuit temperature of that refrigerant circuit of the plurality of refrigerant circuits that has a highest refrigerant circuit temperature.

2. The evaporator of claim 1 wherein each refrigerant circuit that is a cold refrigerant circuit includes its own mini-slab circuit extender.

3. A method of making an evaporator for a cooling system, comprising:

assembling a plurality of refrigerant circuits in a slab coil with each refrigerant circuit being a fin-and-tube coil that extends across the slab coil;

identifying any of the refrigerant circuits that are cold refrigerant circuits wherein a cold refrigerant circuit is any refrigerant circuit having a refrigerant circuit temperature that is at least 15° F. less than a refrigerant circuit temperature of that refrigerant circuit of the plurality of refrigerant circuits that has a highest refrigerant circuit temperature; and assembling a mini-slab circuit extender to at least one of the cold refrigerant circuits so that the mini-slab circuit extender is disposed across only a portion of the fin-and-tube coil of that refrigerant circuit.

4. The method of claim 3 wherein assembling the mini-slab circuit extender to the at least one of the refrigerant circuits includes assembling a mini-slab circuit extender to each cold refrigerant circuit.

* * * * *